US010179089B2

(12) United States Patent
Hoang

(10) Patent No.: US 10,179,089 B2
(45) Date of Patent: Jan. 15, 2019

(54) PATIENT ELECTRICAL TREATMENT SYSTEM

(71) Applicant: Le Trinh Hoang, D.O., Inc., Arcadia, CA (US)

(72) Inventor: Le Trinh Hoang, Arcadia, CA (US)

(73) Assignee: Le Trinh Hoang, D.O., Inc., Arcadia, CA (US)

( * ) Notice: Subject to any disclaimer, the term of this patent is extended or adjusted under 35 U.S.C. 154(b) by 0 days.

(21) Appl. No.: 15/271,856

(22) Filed: Sep. 21, 2016

(65) Prior Publication Data

US 2018/0078451 A1 Mar. 22, 2018

(51) Int. Cl.
*A61H 39/08* (2006.01)
*A61H 39/00* (2006.01)

(52) U.S. Cl.
CPC ..... *A61H 39/002* (2013.01); *A61H 39/086* (2013.01)

(58) Field of Classification Search
CPC ..... A61H 39/002; A61H 39/0086
See application file for complete search history.

(56) References Cited

U.S. PATENT DOCUMENTS

| | | | | |
|---|---|---|---|---|
| 5,054,486 | A | 10/1991 | Yamada | |
| 2003/0135241 | A1 | 7/2003 | Leonard et al. | |
| 2005/0094348 | A1* | 5/2005 | Hattori | A61N 1/14 361/220 |
| 2006/0235465 | A1 | 10/2006 | Koo et al. | |

* cited by examiner

*Primary Examiner* — Paula J Stice
(74) *Attorney, Agent, or Firm* — Jeffrey G. Sheldon; Katherine B. Sales; Cislo & Thomas LLP

(57) ABSTRACT

A kit for discharging electrons from a mammal such as human comprise at least two electrically conductive acupuncture needles. The needles are adapted for creating an electrical connection with subcutaneous tissue of the mammal. There is an electrically conductive pad with electrically conductive pad wires, one for each needle for connection to the respective needle to the pad. Electrically conductive grounding wire is provided for electrically grounding the pad. Helical wires for placement around the acupuncture needles can be used to enhance electrically conductivity. The kit is designed, when assembled and used to treat a mammal, for withdrawing excess electrons from the mammals for improved health.

19 Claims, 2 Drawing Sheets

PATIENT ELECTRICAL TREATMENT SYSTEM

BACKGROUND

Figure 1:
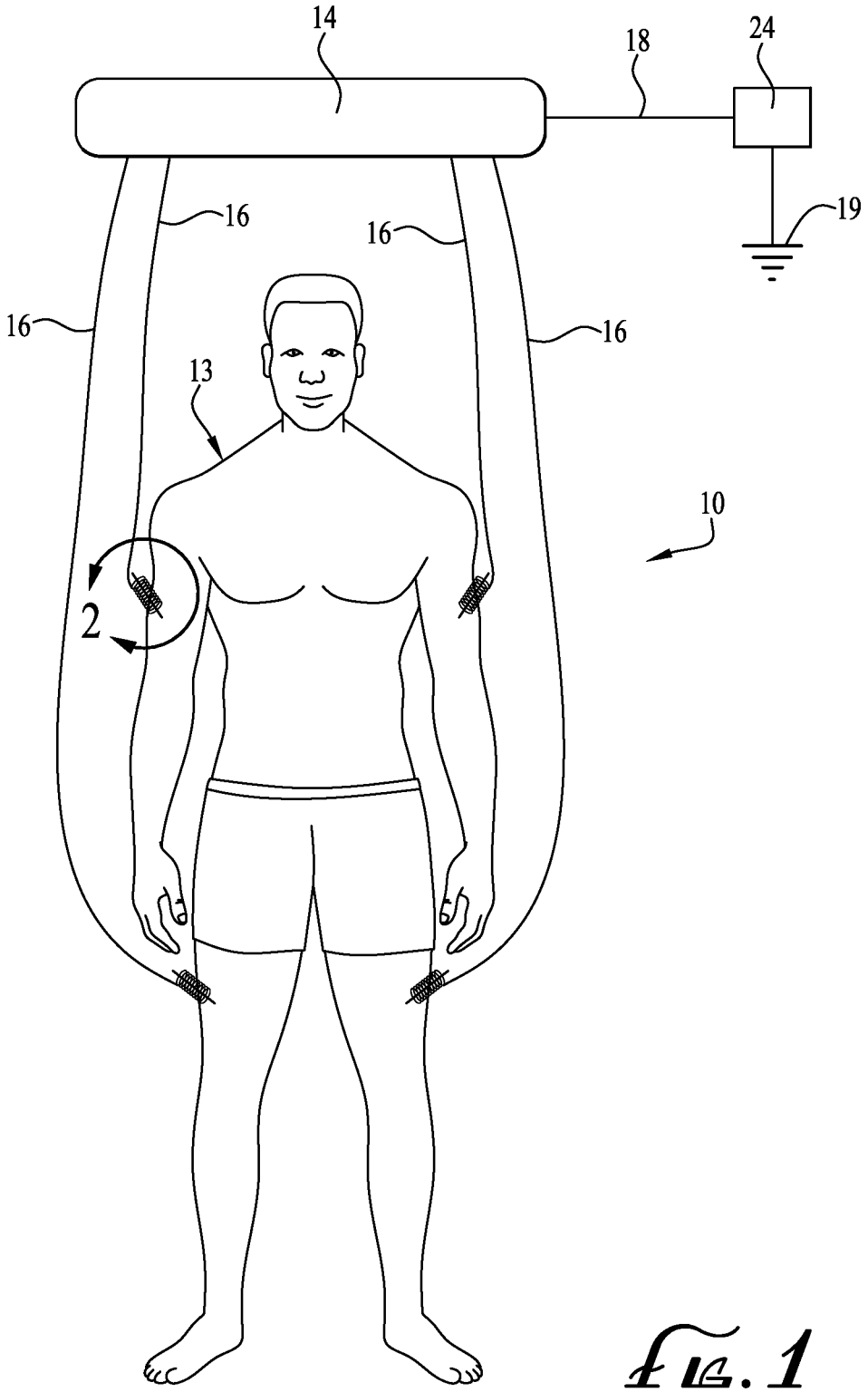

Mammals can have out of balance electron charge with adverse health consequences. Ober et al. U.S. Pat. No. 7,724,491 describes a system where a grounded plane is conductively coupled to a human to conduct the earth's negative surface charges of free electrons from the earth to the animal.

A problem with systems such as Ober is that only surface contact with a human is obtained. Moreover, it is applicant's experience that the usual condition of a human is there is an excess of electrons, so the Ober system transmits electrons in the wrong direction.

Other systems are described in:

CN105030527
CN202933214
KR20120109705
RU157530
US2005/0094348
US2015/0107022
U.S. Pat. No. 3,957,053
U.S. Pat. No. 4,745,517
U.S. Pat. No. 8,882,763
WO06090475

Accordingly, the present invention is directed to improvements that overcome disadvantages of prior art systems.

SUMMARY

The present invention is directed to a system that improves on the prior art systems, providing a deeper treatment and generally withdrawing excess electrons from a mammal.

In particular, a kit for discharging electrons from a mammal comprises at least two electrically conductive acupuncture needles adapted for creating an electrical connection with sub-cutaneous tissue of the mammal. There is an electrically conductive pad and optionally, electrically conductive pad wires for each needle for electrical connection of each needle to the pad. An electrically conductive grounding wire is provided for electrically grounding the pad. Thus the needles, pad wires, pad and the grounding wire, when assembled, allow excess electrons to be withdrawn from the mammal.

Preferably the kit includes a helical copper coil for each needle sized to fit over the respective needle and adapted to be in electrical connection with a respective needle and the electrically conductive pad wire for that needle, preferably via the pad wires.

Preferably the needles are formed of stainless steel. Also preferably a harmonics filter is included for connection to the grounding wire.

In the kit, at least one of the pad wires can be preconnected to its respective needle, such as via the copper helical coil if used.

The invention also includes the method for treating a mammal with the kit of claim 1. In the method, an even number of acupuncture needles have their tips placed subcutaneously in contact with subcutaneous fluid of a mammal, with one of the pad wires electrically connected to each of its respective needle, wherein one half of the needles are placed on each side of the mammals' medial line. For example, one needle can be placed in each of the legs of the mammal. In the method each pad wire is electrically connected to the pad and then the pad is connected with the grounding wire.

The invention also includes a system where the kit is assembled.

DRAWINGS

Figure 2:
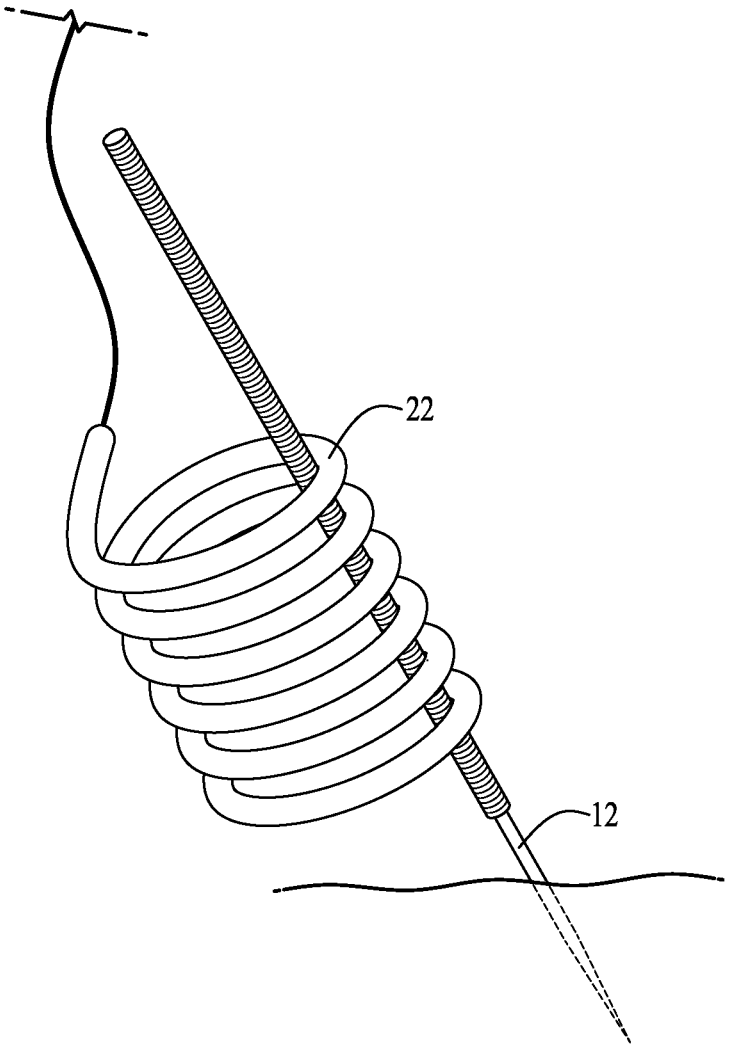

These and other features, aspects and advantages of the present invention will become better understood with reference to the following description, appended claims, and accompanying drawings where:

FIG. 1 is a schematic view of the system having features of the present invention being used for treating a mammal, namely a human; and FIG. 2 is a perspective view of a portion of the system of FIG. 1.

DESCRIPTION

A system having features of the present invention is shown being used in FIG. 1, with FIG. 2 showing perspective close up view of a portion of the system. The system 10 comprises acupuncture needles 12, typically an even number, a patient 13, and an electrically conductive pad 14, also referred to as a grounded plane. Preferably the needles 12 are electrically connected to the pad 14 with electrically conductive pad wires 16, or less preferably, directly electrically connected to the pad with pad wires. The pad 14 is connected to ground with a grounding wire 18.

The term "electrically connected" (and similar terms such as "electrical communication") means that electron flow is possible between two structures with less resistance than provided by air. Electrical connection can involve direct physical connection, or can use an intermediary such as a conductive wire. For example, in the present invention the pad can be in physical contact with the needles or a pad wire can be connected to the pad and a needle (or coil as described below).

Typically, the acupuncture needles are thin metal needles adapted for creating an electrical connection with subcutaneous tissue of a mammal such as the human patient 13 as shown in FIG. 1. The invention is not limited to use for humans, but can be used with other mammals needing treatment.

Typically, the needles 12 are made of stainless steel, making them flexible, rust resistant and break resistant. The needles can be reusable or usable, if sterilized between use. The needles can a length of from about 13-130 mm with a diameter from about 0.16 mm to about 0.46 mm.

Because of the limited electrical conductivity of stainless steel, preferably, but optionally, each needle is provided with a helical copper coil 22 that is in electrical contact with the respective needle 12, with the pad wire 16 connect to the copper coil and the pad 14. The coil need not be made of 100% copper, but can be made of alloys where copper is the predominant compound, generally at least 90% by weight copper.

Typically, the pad wires 16 and the grounding wire 18 are insulated copper wires, single strand or multiple strands, such as four up to about fourteen gauge.

The grounding can be effected by using a typical three prong plug for insertion into a three prong outlet, where the neutral and hot prongs are shortened so that no power current can flow through any part of the device. The elongated grounding prong is used for grounding to an earth ground 19.

The grounding pad 14 can be any shape, such as an elongated strip, round, or rectangular. As stated in the aforementioned Oder patent, such grounding pads can include a mesh layer substrate comprised of a plurality of silver fibers, such as silver coated nylon fibers, having a silver content typically comprising 5% of the fabric. This substrate can comprise 95% polyester, nylon or cotton and 5% silver-suffused monofilament nylon knitted into a conductive grid pattern. Although 5% silver fiber content is preferred, the grounding pad silver fiber content can vary, such as between 1% and 10% silver fibers. The pad 14 serves as a grounded plane.

An optional harmonics filter 24 is between the grounding pad 14 and ground. The harmonics filter 24 can be provided at the beginning of the grounding wire 18, between the ends of the grounding wire 18, or at the terminal end of the grounding wire 18. The filter 24 filters out harmonics. One type of filter is a Satic brand global energy saver ES120 filter available from Satic Incorporated located in Missoula, Mont. Another suitable filter is a Stetzerizer brand available from Stetzer Electric, Inc. Both types of filters filter out transients (electrical surges) and harmonics.

For ease in packing and shipment, the components of the system can be provided as a kit requiring assembly.

Preferably there is an even number of acupuncture needles 12 provided so that one half of the needles is placed on each side of the mammal's medial line, thereby providing electrical balance on both sides of the grounded patient 13. FIG. 1 shows four such needles 12, one in each upper arm of the patient 13 and one in each thigh of the patient 13.

It is found that this system when in use transmits electrons effectively from the patient to the ground. This is because in use the acupuncture needles have their ends placed subcutaneously in contact with the subcutaneous fluid of the mammal, which provides much more effective electron transfer than trying to adjust the electrical balance of a patient using only contact with the epidermis.

A kit can be provided with certain components pre-connected such as having the pad wires connected to their respective needles such as by the pad wires pre-connected to the helical coils.

Although the present invention has been described with regard to certain preferred versions hereof, other versions are possible. For example, the pad wires 16 need not be used, where the pad 14 is in direct electrical conduct with the coils and/or needles. Also the present invention can be used in conjunction with the system of Ober et al. U.S. Pat. No. 7,724,491. Therefore, the scope of the appended claims should not be limited to the preferred embodiments described herein.

What is claimed is:

1. A kit for discharging electrons from a human comprising:

a) at least two electrically conductive acupuncture needles adapted for creating an electrical connection with subcutaneous tissue of the human;

b) an electrically conductive plane for electrical communication with the needles;

c) an electrically conductive grounding wire for electrically grounding the plane to a ground, the grounding wire not being in direct contact with the human; and d) a helical coil sized to fit over the respective needle to be electrically connected with the respective needle and the electrically conductive plane.

2. The kit of claim 1 comprising an electrically conductive plane wire for each coil for connection of the respective coil to the plane.

3. The kit of claim 2 wherein at least one of the plane wires is preconnected to its respective coil.

4. The kit of claim 1 wherein the needles are formed of stainless steel.

5. The kit of claim 1 comprising a harmonics filter for connection to the grounding wire for connection to the ground.

6. The kit of claim 1 comprising an electrically conductive plane wire for each needle for electrical connection of the respective needle to the plane.

7. The kit of claim 6 wherein at least one of the plane wires is preconnected to its respective needle.

8. The kit of claim 1 wherein the coils are formed predominately of copper.

9. A method for treating a human by discharging electrons from the human comprising the steps of:

a) selecting a kit comprising:

i) at least two electrically conductive acupuncture needles adapted for creating an electrical connection with subcutaneous tissue of the human;

ii) an electrically conductive plane external of the human for electrical communication with the needles;

iii) an electrically conductive grounding wire for electrically grounding the plane to a ground, the grounding wire not being in direct contact with the human; and iv) an electrically conductive plane wire for each needle for electrical connection of the respective needle to the plane;

b) placing at least two acupuncture needles subcutaneously in contact with subcutaneous fluid of the human;

c) before or after step b) electrically connecting the plane wires to the needles; and d) before or after step (b) and before or after step (c) connecting the plane to ground distal from the human with the grounding wire for electrons to discharge from the human to the ground.

10. The method of claim 9 wherein the method further comprises step e) before or after any other step, placing a helical coil for each needle in electrical contact with the respective needle, wherein the helical coil is sized to fit over the respective needle and each coil is electrically connected to its respective needle and the plane.

11. The method of claim 10 wherein the kit comprises an electrically conductive plane wire for each needle for electrical connection of the respective coil to the plane, and the method comprises the additional step of electrically connecting each plane wire to its respective coil.

12. The method of claim 9 wherein the kit comprises a harmonics filter and the method includes the step of placing the harmonics filter between the grounding wire and ground.

13. The method of claim 9 wherein step (b) comprises placing ½ of the needles on each side of the human's medial line.

14. A system for discharging electrons from a human comprising:

a) at least two electrically conductive acupuncture needles inserted into a human, creating an electrical connection with subcutaneous tissue of the human;

b) an electrically conductive grounded plane external of the human and electrically connected to the needles; and c) an electrically conductive grounding wire electrically grounding the plane to a ground external of the human, the grounding wire not being in direct contact with the human.

15. The system of claim 14 comprising an electrically conductive plane wire for each needle in electrically conductive connection to its respective needle and the plane.

16. The system of claim 15 comprising a helical coil for each needle and sized to fit over the respective needle and adapted to be in electrical contact with the respective needle and the electrically conductive plane wire for that needle.

17. The system of claim 14 comprising a helical copper coil for each needle and sized to fit over the respective needle and adapted to be in electrical contact with the respective needle and the electrically conductive plane wire for that needle.

18. The system of claim 14 wherein the needles are formed of stainless steel.

19. The system of claim 14 comprising a harmonics filter connected to the grounding wire.

* * * * *